US008052133B2

(12) United States Patent
Hug et al.

(10) Patent No.: US 8,052,133 B2
(45) Date of Patent: Nov. 8, 2011

(54) METHOD AND ARRANGEMENT FOR PRODUCING AN ADHESIVE-BOUND PRINTED ITEM COMPOSED OF SEVERAL PRINTED PRODUCTS

(75) Inventors: Theo Hug, Wallenwil TG (CH); Peter Fischer, Winterthur ZH (CH); Christophe Vaucher, Frauenfeld TG (CH)

(73) Assignee: Mueller Martini Holding AG, Hergiswil (CH)

( * ) Notice: Subject to any disclaimer, the term of this patent is extended or adjusted under 35 U.S.C. 154(b) by 833 days.

(21) Appl. No.: 11/889,344

(22) Filed: Aug. 10, 2007

(65) Prior Publication Data

US 2008/0232931 A1 Sep. 25, 2008

(30) Foreign Application Priority Data

Aug. 10, 2006 (EP) ..... 06405338

(51) Int. Cl.
*B65H 37/04* (2006.01)
*B65H 39/00* (2006.01)

(52) U.S. Cl. ..... 270/52.16; 270/52.14; 270/52.18

(58) Field of Classification Search ..... 270/52.14, 270/52.16, 52.18, 52.19; 271/82, 85, 204, 271/206

See application file for complete search history.

(56) References Cited

U.S. PATENT DOCUMENTS

| | | | | |
|---|---|---|---|---|
| 5,005,815 | A | 4/1991 | Auksi | |
| 5,261,520 | A | 11/1993 | Duke | |
| 5,660,382 | A | 8/1997 | Meier | |
| 6,264,192 | B1 | 7/2001 | Siebenmann et al. | |
| 6,702,100 | B2 * | 3/2004 | Studer | 198/470.1 |
| 6,726,201 | B2 * | 4/2004 | Studer | 271/204 |
| 6,764,069 | B2 * | 7/2004 | Reist | 270/52.29 |
| 2003/0183999 | A1 | 10/2003 | Reist | |
| 2008/0038091 | A1 | 2/2008 | Langenegger | |

FOREIGN PATENT DOCUMENTS

| | | | |
|---|---|---|---|
| CA | 2 258 089 | | 1/1998 |
| DE | 2016425 | | 10/1971 |
| DE | 28 10 518 | | 10/1978 |
| DE | 29 43 260 | A1 | 5/1981 |
| DE | 10 2007 032 604 | | 1/2008 |
| EP | 0 386 787 | A2 | 9/1990 |
| EP | 0 675 005 | B1 | 1/1995 |

(Continued)

OTHER PUBLICATIONS

European Search Report, dated Jan. 5, 2007, issued for counterpart European Application No. 06405337.4-2304 (w/English-language Translation).

(Continued)

*Primary Examiner* — Leslie A Nicholson, III
(74) *Attorney, Agent, or Firm* — Venable LLP; Robert Kinberg; Leigh D. Thelen

(57) ABSTRACT

A method and arrangement is provided for producing an adhesive-bound printed item composed of a plurality of printed products. The printed products are gathered into loose book blocks along a first conveying section of a conveying track for a circulating conveyor while positioned transverse to a conveying direction and inclined counter to the conveying direction. The book blocks are then accelerated in an additional section of the circulating conveyor to obtain a larger divisional spacing between the printed products. The book blocks are transferred from the additional section of the circulating conveyor to clamps of a transporter and pivoted to an upright position where one side edge is approximately parallel to the conveying direction. The book blocks are transferred from the clamps of the transporter into respective circulating conveying clamps of an adhesive binder.

10 Claims, 1 Drawing Sheet

FOREIGN PATENT DOCUMENTS

| | | | |
|---|---|---|---|
| EP | 0 675 005 | A1 | 10/1995 |
| EP | 1 528 023 | A1 | 8/2004 |
| EP | 1 520 817 | | 4/2005 |
| EP | 1 712 495 | A2 | 4/2006 |
| EP | 1 669 312 | | 6/2006 |
| EP | 1 834 911 | | 9/2007 |
| EP | 1 886 832 | | 2/2008 |
| EP | 1 886 833 | | 2/2008 |
| FR | 2 206 748 | | 6/1974 |
| GB | 973639 | | 10/1964 |
| GB | 2 055 767 | A | 3/1981 |
| WO | WO-96/32293 | | 10/1996 |
| WO | WO 98/03422 | | 1/1998 |

OTHER PUBLICATIONS

European Search Report, dated Feb. 2, 2007, issued for counterpart European Application No. 06405338.2-1251 (w/English-language Translation).

U.S. Office Action dated Jul. 19, 2010, issued in related U.S. Appl. No. 11/889,272.

Extended European Search Report dated Apr. 15, 2009, directed to a related European Patent Application No. EP 08405248.9, and an English-language translation.

Non-Final Office Action dated Mar. 9, 2011, issued in related U.S. Appl. No. 12/572,547.

* cited by examiner

METHOD AND ARRANGEMENT FOR PRODUCING AN ADHESIVE-BOUND PRINTED ITEM COMPOSED OF SEVERAL PRINTED PRODUCTS

CROSS-REFERENCE TO RELATED APPLICATIONS

This application claims the priority of European Patent Application No: 06405338.2-1251, filed on Aug. 10, 2006, the subject matter of which is incorporated herein by reference. Reference is additionally made to concurrently filed and co-owned application Ser. No. 11/889,272 which relates to the subject matter herein and is incorporated herein by reference in its entirety.

BACKGROUND OF THE INVENTION

The invention relates to a method for producing an adhesive-bound printed item composed of several printed products, for which the printed products are gathered along a first conveying section of a conveying track for a circulating conveyor and gathered into loose book blocks, and are then supplied with a following conveying section to an adhesive binder. The invention furthermore relates to an arrangement for realizing the method.

With the methods used in the print processing industry for the adhesive binding of printed products to form printed items, the individual printed products are first gathered in a gathering machine into loose book blocks, and are subsequently transferred to the conveying clamps of an adhesive binder. The transfer from the gathering machine to the adhesive binder among other things involves the function of taking over the gathered loose book blocks, which move at the speed and with the orientation of the gathering machine, and to transfer these book blocks to the adhesive binder at the speed of the adhesive binder.

According to a one known system, the book blocks can be conveyed in the gathering machine while positioned upright and in the direction of the book block spine, inside a conveying channel with a V-shaped cross section that is inclined slightly counter to the back fold. The book blocks are transferred in a vertical plane to the adhesive binder, which also moves in a longitudinal direction of the spine, wherein the back folds of the book blocks are oriented in a downward direction. Inside the gathering machine, the book blocks are normally conveyed form-fittingly with the aid of pushers attached to chains, which push along the book blocks. If no optional processing of the book blocks is required inside the transfer region, such as vibrating, adding sections, gluing on of end sheets, wire-stitching, printing, and the like, then the book blocks need only to be moved from a slightly inclined position to an upright position during the conveying in the longitudinal direction of the spine. If the gathering machine stops, the adhesive binder can continue to operate and finish the processing of the remaining book blocks. As a result, the divisional spacing between successively following book blocks of necessity increases while the conveying speed becomes relatively high. The conveying speed thus can be the limit speed for a maximum production speed. Above all, this applies to the channel region of the gathering machine where the conveying operation generates turbulence in the air, which in turn causes buoyancy forces for the top printed products of the loose book blocks that can lift up these sheets from the book blocks. An additional disadvantage of this solution manifests itself when the gathering machine is stopped because the loose book blocks shoot forward as a result of their kinetic energy, which may cause a loss of orientation.

A different solution according to another known system is disclosed in European Patent Application 0 675 005 B1, which calls for the loose book blocks to be conveyed inside the adhesive binder while positioned transverse to the longitudinal direction of the spine. The conveying speed can thus be reduced while the production speed remains the same, as compared to a conveying in the longitudinal direction of the spine. The disadvantage of this principle is that the adhesive binder requires a complicated configuration.

According to published European Patent Application 1 528 023 A1, the printed sheets, which are positioned transverse to the longitudinal direction of the spine on a conveying belt, are gathered to form overlapping flows and are then separated into individual book blocks just prior to the transfer to an adhesive binder which moves in longitudinal direction. Following the separation, the individual book blocks are transferred to laterally moving compartments and placed in the upright position, so that the book block spines point downward. They are subsequently deflected by an angle of 90° and moved to a conveyed flow in which they are conveyed with the spine aligned in conveying direction. The disadvantage of this method is that book blocks having thicker or smaller formats, as well as book blocks with a rigid content such as CD's, cannot be processed.

SUMMARY OF THE INVENTION

It is therefore an object of the present invention to transfer a book block, composed of printed products gathered along a first conveying section of a conveying track while positioned transverse to the conveying direction, to an adhesive binder in which the book block is aligned in the conveying direction.

The above and other objects of the invention are accomplished according to the invention wherein according to one embodiment there is provided a method for producing an adhesive-bound printed item composed of a plurality of printed products, comprising: gathering the printed products into loose book blocks along a first conveying section of a conveying track for a circulating conveyor with the book blocks being positioned transverse to a conveying direction and inclined counter to the conveying direction; accelerating the book blocks in an additional section of the circulating conveyor following the first section to obtain a larger divisional spacing between the printed products; transferring the book blocks from the additional section of the circulating conveyor to clamps of a transporter and pivoting the book blocks to an upright position where one side edge is approximately parallel to the conveying direction; and transferring the book blocks from the clamps of the transporter into respective circulating conveying clamps of an adhesive binder.

According to another aspect of the invention there is provided and arrangement for producing an adhesive-bound printed item composed of a plurality of printed products, which in one embodiment comprises: a circulating conveyor including spaced-apart conveying units driven around a conveying track, the circulating conveyor further including: a first conveying section of the conveying track along which the printed products are gathered into loose book blocks in the spaced-apart conveying units positioned transverse to the conveying direction and including backs inclined counter to the conveying direction, and a second conveying section along which the spaced-apart conveying units are accelerated to obtain a larger divisional spacing between the conveying units; a transporter including circulating and pivotable clamps operatively arranged in relation to the circulating conveyor to effect a transfer of the book blocks from the conveying units to the circulating and pivotable clamps of the transporter; and a surface guide operatively arranged and shaped to contact the book blocks while clamped by the circulating and pivotable clamps of the transporter and effect a pivoting of the book blocks into an upright position to permit transfer to circulating clamps of an adhesive binder.

BRIEF DESCRIPTION OF THE DRAWINGS

The above and other features and advantages of the invention will be further understood from the following detailed description of embodiments within the scope of the invention, with reference to the accompanying drawing.

DETAILED DESCRIPTION

Figure 1:
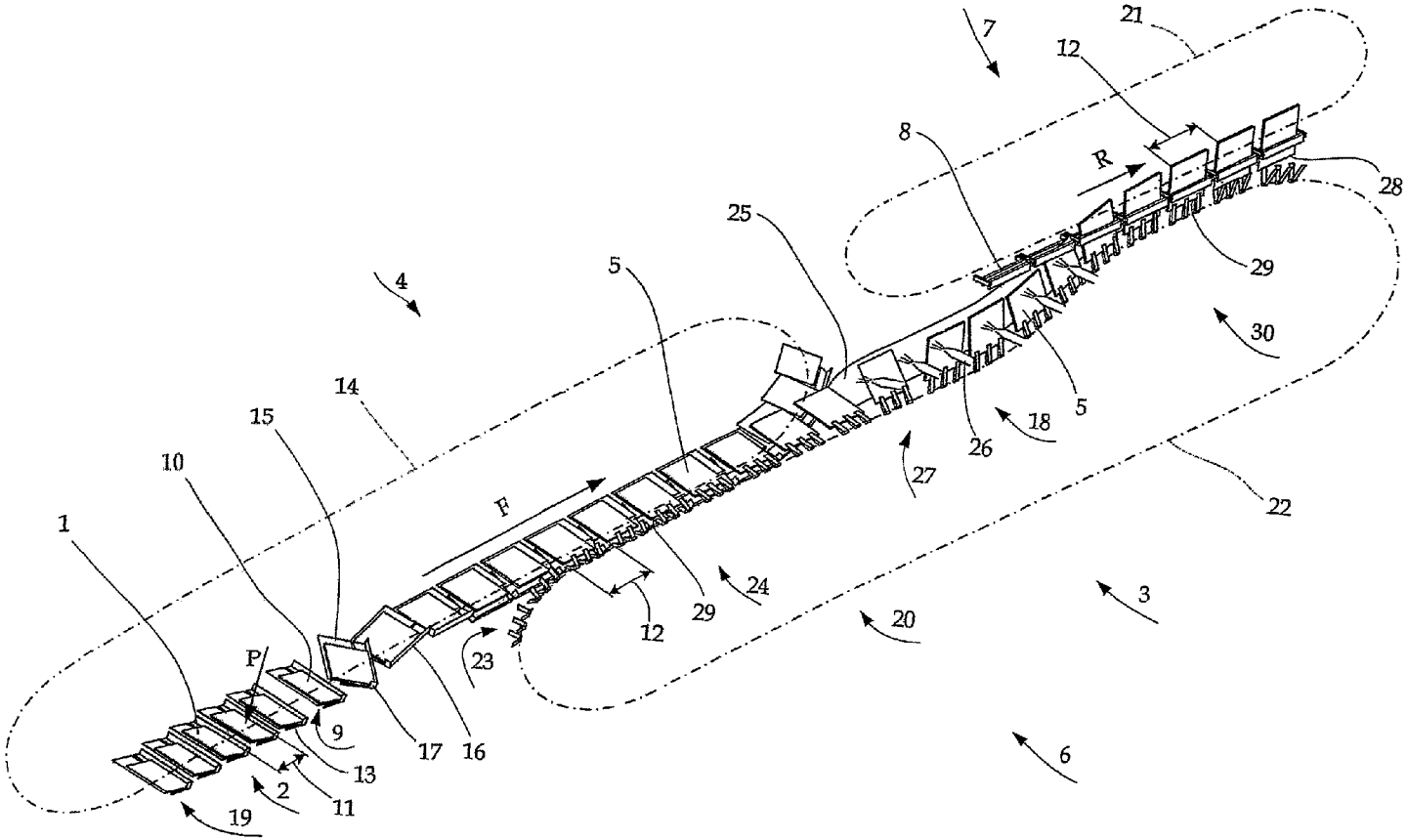
FIG. 1 shows a simplified schematic of an adhesive binder incorporating principles of the invention.

Referring to FIG. 1, there is shown a conveying apparatus 6 with a circulating conveyor 4, with the aid of which printed products 1 are gathered along a first conveying section 2 of a conveying track 14 and are gathered into loose book blocks 5. The conveyor 4 includes a plurality of successively arranged conveying units 19, which circulate along the guide track 14. Each conveying unit 19 is embodied to be adjustable, for example, with the aid of a mechanical control device, such that the speed and the spacing between the conveying units 19 can be changed. Each conveying unit 19 essentially consists of a platform 15 with an end stop 16 arranged at the lower end, as well as an end stop 17 on the side upon which an end side region 13 of the print products rest. The conveying units 19 can be pivoted around at least one axis, relative to the conveying direction F. In a first conveying section 2 of conveyor 4, the conveying units 19 are arranged in a reclined position that is inclined counter to the conveying direction F and is slightly inclined toward the side end stop 17. This may cause the respectively lowest printed product 1 to rest on the platform 15 and side edges 29 of the gathered printed products 1, which will become the spine of the printed product, to rest against the end stop 16.

The printed products 1 are supplied to the conveying units 19, in a manner known per se, by sheet feeders (not shown herein) that are arranged along the first conveying section 2. To reduce the effect of the damaging slipstream, the divisional spacing 11 between successively conveyed units 19 is kept to a minimum in the first conveying section 2.

In contrast to the first conveying section 2, once the book blocks 5 are positioned in the conveying clamps 8 of a downstream arranged adhesive binder 7, which circulate along a track 21, they have a different orientation as well as greater divisional spacing 12. The side edges 29 of the printed products 1, which rest against the end stops 16, form a book block spine 28. The printed products 1 of a book block 5 are accelerated in a second conveying section 3 of conveyor 4, such that a greater divisional spacing 12 is achieved, and are furthermore pivoted about an axis transverse to the conveying direction, for example a vertical axis, so that the side edges 29 are positioned approximately parallel to the conveying direction F. The book blocks are transferred from this position to the evenly spaced-apart clamps 23 of a transporter 20 that are driven along a closed track 22 of the transporter 20.

At least by the time the book blocks 5 reach the end of the first conveying section 2, the book blocks 5 are held inside the conveying units 19 by holding forces P, wherein this is necessary to prevent the book blocks 5 from moving inside the conveying units 19 during the accelerating and/or pivoting movement. The holding forces P may be generated, for example, by blast air nozzles in a manner similar to the operation of blast air nozzles 26 described below.

To allow access by the transporter 20, the side end stop 17 and the end stop 16 are moved away from the book block 5, thereby exposing the book block spine 28 and the regions adjacent to the spine. The clamps 23 are embodied such that they can pick up the book blocks 5 along the flat sides 9, 10. The guide track 14 of the conveyor 4 and the circulating track 22 of the transporter 20 move parallel to each other in a transfer region 24, so that the conveying units 19 and the transporter 20 move at the same speed.

At the beginning of a transfer region 24, the opened clamps 23 of the transporter 20 are fitted over the side regions adjacent to the spine of the book block 5 and are then closed. Once the holding force P is removed, the book blocks 5 are held in place exclusively by the force of the clamps 23 while still positioned on the platforms 15 of the conveying units 19. Downstream of the transfer region 24, the guide track 14 for the conveying units 19 and the circulating track 22 of the transporter 20 move in separate directions. The book blocks 5 are positioned with the lower, flat side 9 on a guide surface 25 of a guiding device 18. The empty conveying units 19 are subsequently returned to the start of the first conveying section 2 on the conveying track 14. During the return movement of the conveying units 19 along the guide track 14, the divisional spacing 11 between the conveying units 19 is once more established and the end stops 16 as well as the side end stops 17 are moved back to their operating positions.

The guide surface 25 has a spiral-shaped design, so that during the conveying operation the book blocks 5 are pivoted around an axis that is parallel to the conveying direction F until the flat sides 9, 10 of the upright book blocks 5 are positioned in a vertical plane parallel to the conveying direction. On the sides of the book blocks remote from the guide surface 25, there are provided a plurality of blast air nozzles 26 that jointly form a blast air supply 27 to hold the book blocks in position against the guide surface 25. Alternatively, a sliding guide may be utilized to hold the book blocks in place. The clamps 23 that hold the book blocks 5 can be pivoted around an axis extending parallel to the conveying direction F. At the location where the circular track 22 for transporter 20 approaches the track 21 for adhesive binder 7, the loose book blocks 5 are transferred to the conveying clamps 8. This may be effected by an upward incline of the track 22 of transporter 20 in an end region 30 which causes the book blocks to be inserted from below into the conveying clamps 8 of the adhesive binder 7. At the end region 30 of transporter 20, conveying clamps 23 with the book blocks move at the same speed as conveying clamps 8 and in the same direction as the conveying direction R for the circulating conveying clamps 8 of the adhesive binder 7. The conveying clamps 8 are closed first in this end region 30, so that the loose book blocks 5 are held firmly in place by the force of the locked clamps. Following this, the clamps 23 of the transporter 20 are opened and the opened clamps 23 are moved back along the circulating track 22 in order to pick up additional loose book blocks 5 from the conveying units 19 in the transfer region 24.

It will be understood that the above description of the present invention is susceptible to various modifications, changes and adaptations, and that the same are intended to be comprehended within the meaning and range of equivalents of the appended claims.

What is claimed is:

1. A method for producing an adhesive-bound printed item composed of a plurality of printed products, comprising:

gathering the printed products into loose book blocks along a first conveying section of a conveying track for a circulating conveyor with the book blocks being positioned transverse to a conveying direction and inclined counter to the conveying direction;

accelerating the book blocks in an additional section of the circulating conveyor following the first section to obtain a larger divisional spacing between the printed products;

transferring the book blocks from the additional section of the circulating conveyor to clamps of a transporter;

pivoting the book blocks to an upright position where one side edge is approximately parallel to the conveying direction; and transferring the book blocks from the clamps of the transporter into respective circulating conveying clamps of an adhesive binder.

2. The method according to claim 1, including positioning the book blocks while in the circulating conveyor so that the one side edge forms the book block spine.

3. The method according to claim 1, wherein the transferring of the book blocks to the transporter occurs while maintaining the positioning of the loose book blocks.

4. The method according to claim 1, including firmly holding the printed products and/or the loose book blocks in place along the first conveying section by a force applied to their flat sides.

5. The method according to claim 1, further comprising holding the loose book blocks by a force-locking connection generated prior to the accelerating.

6. An arrangement for producing an adhesive-bound printed item composed of a plurality of printed products, comprising:

a circulating conveyor including spaced-apart conveying units driven around a conveying track, the circulating conveyor further including:

a first conveying section of the conveying track along which the printed products are gathered into loose book blocks in the spaced-apart conveying units positioned transverse to the conveying direction and including backs inclined counter to the conveying direction; and a second conveying section along which the spaced-apart conveying units are accelerated to obtain a larger divisional spacing between the conveying units;

a transporter including circulating and pivotable clamps operatively arranged in relation to the circulating conveyor to effect a transfer of the book blocks from the conveying units to the circulating and pivotable clamps of the transporter; and a surface guide operatively arranged and shaped to contact the book blocks while clamped by the circulating and pivotable clamps of the transporter and effect a pivoting of the book blocks into an upright position to permit transfer to circulating clamps of an adhesive binder.

7. The arrangement according to claim 6, wherein the transporter has an end region that moves at the same speed and in the same direction as a conveying direction of the circulating conveying clamps for the adhesive binder.

8. The arrangement according to claim 6, wherein the conveying units include holders for the printed products and/or the loose book blocks.

9. The arrangement according to claim 8, further including a holding device arranged to act upon the printed products and/or the loose book blocks while clamped by the circulating and pivotable clamps of the transporter.

10. The arrangement according to claim 9, characterized wherein the holding device comprise a blast-air supply.

* * * * *